US012624650B2

(12) United States Patent
Goldman Taylor et al.

(10) Patent No.: US 12,624,650 B2
(45) Date of Patent: May 12, 2026

(54) TAPERED ENGINE EXHAUST VALVE

(71) Applicant: Caterpillar Inc., Peoria, IL (US)

(72) Inventors: Rachel M. Goldman Taylor, Peoria, IL (US); Adam D. Patrick, Cary, NC (US); James D. Peltier, West Lafayette, IN (US); Abram M. Ingold, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 65 days.

(21) Appl. No.: 18/665,004

(22) Filed: May 15, 2024

(65) Prior Publication Data

US 2025/0354504 A1 Nov. 20, 2025

(51) Int. Cl.
*F01L 3/20* (2006.01)
*F01L 3/02* (2006.01)

(52) U.S. Cl.
CPC .. *F01L 3/20* (2013.01); *F01L 3/02* (2013.01)

(58) Field of Classification Search
CPC ..... F01L 3/02; F01L 3/06; F01L 3/14; F01L 3/20; F01L 2820/01; F01L 2820/02; F02F 1/24
USPC ..... 123/90.1, 90.14, 90.23, 90.28, 90.48, 123/188.11, 188.3, 190.7, 190.9
See application file for complete search history.

(56) References Cited

U.S. PATENT DOCUMENTS 4,073,474 A * 2/1978 Hashimoto ..... F16K 1/38 251/368
5,019,332 A * 5/1991 Wegman ..... C22C 38/48 420/47
5,592,913 A 1/1997 Matthews
11,850,690 B2 * 12/2023 Yoshino ..... B23P 15/002
2004/0261746 A1 * 12/2004 Narasimhan ..... F01L 3/14 29/888.4
2011/0126791 A1 * 6/2011 Tanaka ..... C21D 1/10 148/559
2016/0215660 A1 * 7/2016 Kawaguchi ..... C22C 19/058

FOREIGN PATENT DOCUMENTS

CN 205189989 U 4/2016
CN 212454567 U 2/2021
DE 102007026018 B4 1/2023

OTHER PUBLICATIONS

Listing of Admitted Prior Art Valves.

* cited by examiner

*Primary Examiner* — George C Jin
*Assistant Examiner* — Johnny H Hoang
(74) *Attorney, Agent, or Firm* — Bookoff McAndrews, PLLC

(57) ABSTRACT

An exhaust valve for an internal combustion engine may comprise a body, including an upper portion, a lower portion, and a tapered portion between an upper end and a lower end of the body, wherein a ratio of (a) a length between an upper end of the upper portion and an upper end of the tapered portion to (b) a length between the upper end of the upper portion and a lower end of the tapered portion is in a range of 0.73 to 0.76, and a taper of the tapered portion is in a range of 0.0012/mm to 0.0030/mm. The exhaust valve may also comprise a head portion extending from a bottom of the lower portion of the body.

20 Claims, 7 Drawing Sheets

TAPERED ENGINE EXHAUST VALVE

TECHNICAL FIELD

The present disclosure relates generally to a tapered exhaust valve for an internal combustion engine, and, more particularly, to an engine exhaust valve having a body with a tapered portion.

BACKGROUND

In an internal combustion engine, exhaust valves move within valve guides in a head of the engine, between a closed position, in which the exhaust valve retains an air and fuel mixture in the combustion chamber during compression and combustion of the mixture, and an open position, in which the exhaust valve releases exhaust gases generated during combustion from the combustion chamber. The exhaust valves are subjected to extreme temperatures and extreme temperature changes, as well as corrosive exhaust gases generated during combustion. The extreme temperatures and extreme temperature changes cause the exhaust valves to change in size, including diameter or thickness, during operation. Specifically, when exhaust valves are exposed to the extremely high engine exhaust gas temperatures, the valves expand or increase in size. The temperature changes are also concentrated towards one end of the exhaust valve, that is, towards the end of the exhaust valve in contact with the exhaust gases and located nearest to a combustion chamber of the engine. Therefore, the exhaust valve is subjected to varying temperatures from one end to another. In addition, exhaust valves are sized to ensure a slight positive diametric clearance between the exhaust valve and the valve guide during operation, to allow for movement of the exhaust valve within the valve guide, while preventing the exhaust valve from sticking to the valve guide. At a start of engine operation, a valve guide may be at a relatively low temperature (i.e., a "cold guide"), whereas the exhaust valve may be at a relatively high temperature (i.e., "hot valve"), which could result in a reduction of diametrical clearance between the valve guide and the exhaust valve, and, in some cases, a negative diametrical clearance.

Due to the relatively low diametrical clearance between exhaust valves and valve guides, and due to the extreme temperatures, extreme temperature changes and the resulting change in size, and the potential for a cold guide and hot valve, known exhaust valves are liable to thermally expand in size, and therefore stick to valve guides, which reduces the efficiency and performance of the engine, and in some cases, the exhaust valves may fail or break. Exhaust valves are also subjected to tensile forces applied by valve springs at upper ends of the exhaust valves, which can also cause exhaust valves to fail.

Chinese Patent No. 212454567U (the '567 patent) provides for an exhaust valve for a diesel engine, the valve having a rod part and a disc part. The rod part includes first, second and third sections, with the second section decreasing in diameter from a minimum diameter, nearest the third section, to a maximum diameter nearest the first section. The rod sections are connected to adjacent rod sections and/or to the disc part using a circular arc transition connection. In addition, the rod sections are formed of nickel-based alloys, specifically, alloys having a nickel content between 20 and 40. However, the exhaust valve of the '567 patent may be improved with respect to one or more of sticking-prevention, manufacturing, and material.

The tapered exhaust valves and related method of manufacture of the present disclosure may solve one or more of the problems set forth above and/or other problems in the art. The scope of the current disclosure, however, is defined by the attached claims, and not by the ability to solve any specific problem.

SUMMARY

In one aspect of the present disclosure, an exhaust valve for an internal combustion engine may comprise a body, including an upper portion, a lower portion, and a tapered portion between an upper end and a lower end of the body, wherein a ratio of (a) a length between an upper end of the upper portion and an upper end of the tapered portion to (b) a length between the upper end of the upper portion and a lower end of the tapered portion is in a range of 0.73 to 0.76, and a taper of the tapered portion is in a range of 0.0012/mm to 0.0030/mm; and a head portion extending from a bottom of the lower portion of the body.

In another aspect of the disclosure, an exhaust valve for an internal combustion engine may comprise a body including an upper portion, a lower portion, and a tapered portion between an upper end and a lower end, wherein a ratio of (a) a length between an upper end of the upper portion and an upper end of the tapered portion to (b) a length between the upper end of the upper portion and a lower end of the tapered portion is in a range of 0.77 to 0.79; and a head portion extending from bottom of the lower portion of the body, wherein the exhaust valve is formed of a nickel-based alloy having a nickel content of 60% to 80%.

In still another aspect of the present disclosure, a method of manufacturing an exhaust valve for an internal combustion engine may comprise forging an exhaust valve to have: a body, including an upper portion, a lower portion, and a tapered portion between an upper end and a lower end, wherein a ratio of (a) a length between an upper end of the upper portion and an upper end of the tapered portion to (b) a length between the upper end of the upper portion and a lower end of the tapered portion is in a range of 0.73 to 0.76, and a taper of the tapered portion is in a range of 0.0012/mm to 0.0031/mm; and a head portion extending from bottom of the lower portion of the body, wherein the exhaust valve is formed of a nickel-based alloy having a nickel content of 60% to 80%.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion, such that a process, method, article, or apparatus that comprises a list of elements does not include only those elements, but may include other elements not expressly listed or inherent to such a process, method, article, or apparatus. Moreover, in this disclosure, relative terms, such as, for example, "about," "generally, "substantially," and "approximately" are used to indicate a possible variation of ±10% in the stated value, unless a variation amount is otherwise stated.

Figure 1:
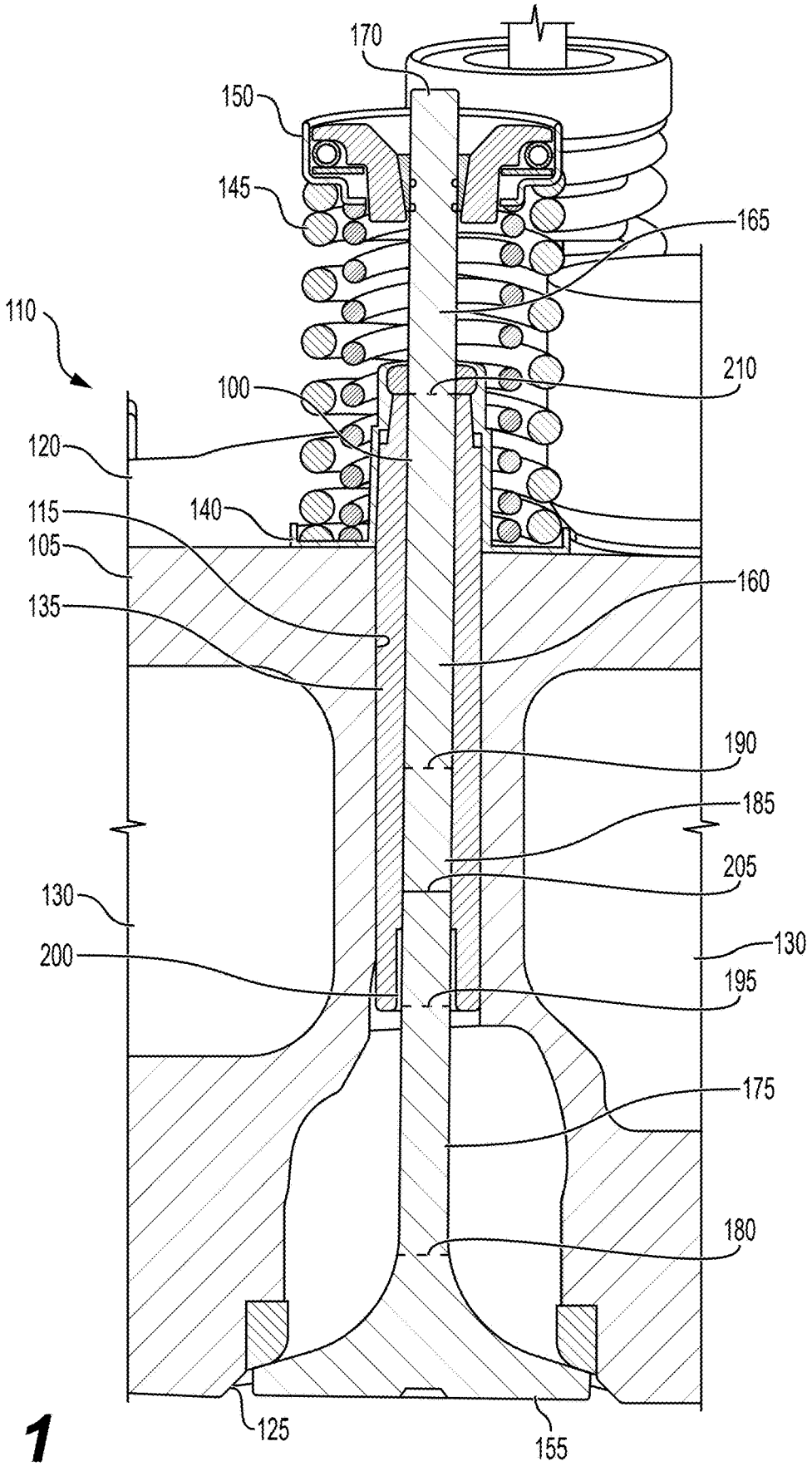
FIG. 1 shows a schematic cutaway cross-sectional view of an exhaust valve, according to one embodiment, within an engine head of an internal combustion engine, in accordance with the present disclosure.

FIG. 1 shows a schematic cutaway cross-sectional view of an exhaust valve 100, according to one embodiment, within an engine head 105 of an internal combustion engine 110, in accordance with the present disclosure. The engine head 105 includes a cylindrical bore 115 extending from an outer surface 120 to an inner surface 125 defining a combustion chamber (not shown). The engine head 105 also includes cooling chambers 130 configured to hold a fluid (e.g., water) for cooling the engine head 105 and components therein during operation of the internal combustion engine 110. A valve guide 135 is positioned within the cylindrical bore 115 of the engine head 105, and the exhaust valve 100 is positioned within the valve guide 135. The valve guide 135 may also include a counter bore 200, which may be about 11 mm in length, from a lower end of the valve guide 135, and which increases a diametrical clearance between the valve guide 135 and the exhaust valve 100. A portion of the valve guide 135 and a portion of the exhaust valve 100 protrude from the outer surface 120 of the engine head 105. A spring seat 140 is mounted onto the engine head 105 and around the protruding portion of the valve guide 135. A valve spring 145 is positioned on the spring seat 140, and around the protruding portion of the valve guide 135 and the protruding portion of the exhaust valve 100. A valve cap 150 is positioned on the exhaust valve 100 and the valve spring 145, with the valve spring 145 being held between the valve cap 150 and the outer surface 120 of the engine head 105, as shown in FIG. 1.

The exhaust valve 100 has a head 155 and a body 160. When the exhaust valve 100 is placed into the engine head 105, the head 155 is positioned near the inner surface 125 of the engine head 105, facing the combustion chamber, and the body 160 is positioned at least in part within the valve guide 135 and within the cylindrical bore 115 of the engine head 105. During operation of the internal combustion engine 110, the exhaust valve 100 moves within the valve guide 135 and the cylindrical bore 115, between a closed position, in which the head 155 closes off an opening along the inner surface 125 of the engine head 105 to retain the air-fuel mixture during a compression cycle and exhaust gases, as byproducts of combustion, during a combustion cycle, and an open position, in which the head 155 is positioned below and spaced from the inner surface 125 of the engine head 105, to exhaust the byproducts of combustion. Between the closed position and the open position, the body 160 of the exhaust valve 100 translates within the valve guide 135 and the cylindrical bore 115, with a portion of the body 160 that moves within the valve guide 135 being defined as a guided length $L_{GUIDED}$ (shown in FIG. 2.). The exhaust valve 100 is held in the closed position by the valve cap 150 and the valve spring 145, which biases or forces the valve cap downward. As a result of the combustion cycle, forces of pressurized gases (or byproducts of combustion) within the combustion chamber exceed the force of the valve spring 145 and valve cap 150, and move the exhaust valve 100 to the open position.

The head 155 and at least a portion of the body 160 may be integrally formed, such that the head 155 extends from a bottom of the body 160 (or, put another way, the body 160 extends from a top of the head 155). The body 160 has an upper portion 165, including an upper end 170 of the body 160, a lower portion 175, adjacent to the head 155 and including a lower end 180 of the body 160, and a tapered portion 185 in between the upper portion 165 and the lower portion 175. The lower end 180 of the body 160 corresponds to a point on the exhaust valve 100 at which a curve of the head 155 ends and a straight portion, i.e., the lower portion 175, begins. The tapered portion 185 includes an upper end 190 and a lower end 195, defining a location of the tapered portion 185 along the body 160. The body 160 may be formed of two distinct parts or portions connected together at an attachment point 205. As an example, the two distinct parts may be connected at the attachment point 205 together using welding. The attachment point 205 may be located within the tapered portion 185, and may be the only attachment point 205 along the body 160 and on the exhaust valve 100.

Figure 2:
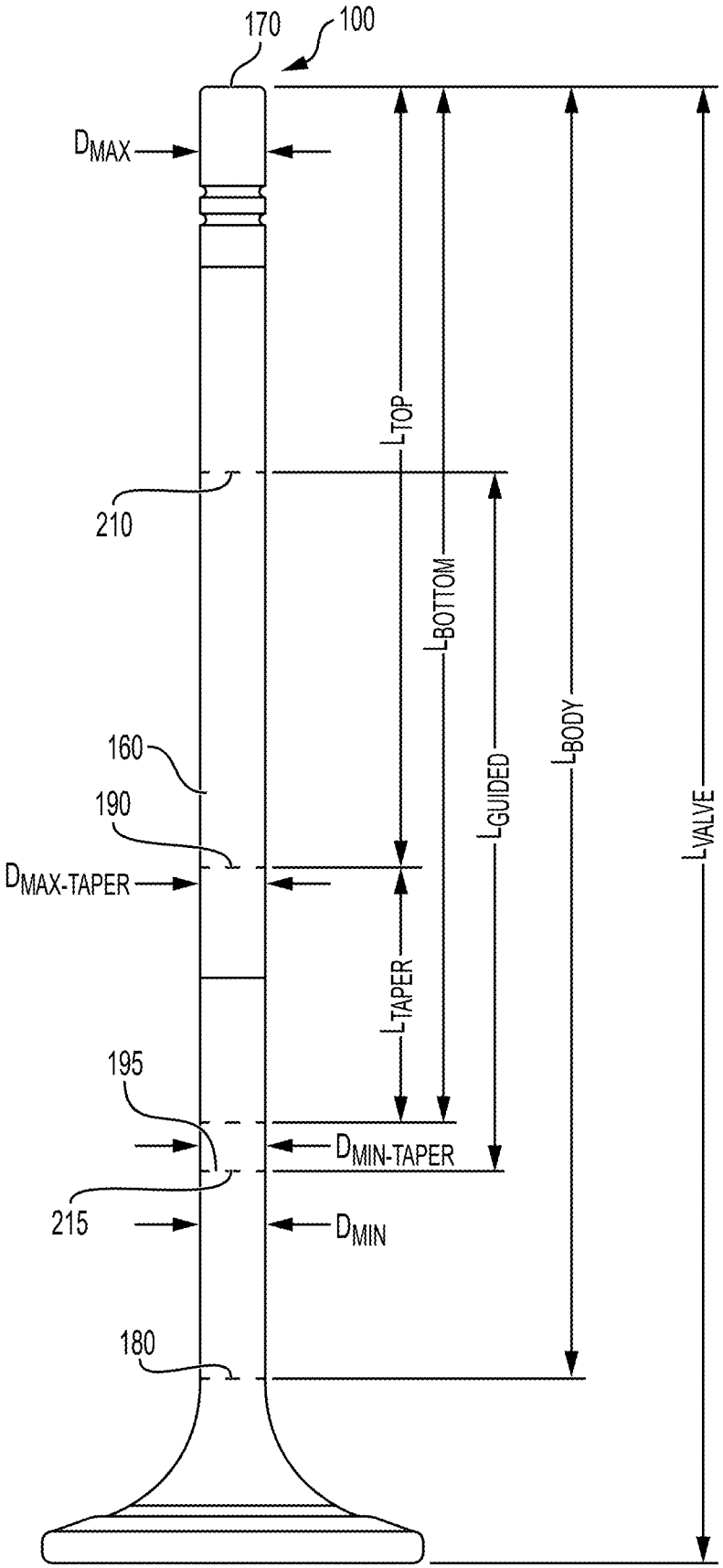
FIG. 2 is a schematic side view of the exhaust valve shown in FIG. 1, in accordance with the present disclosure.

The body 160 and the head 155 may be formed of an alloy. The combination of the body 160 and the head 155 may be formed of a material selected from the group consisting of 23-8N, an Inconel® alloy, or Silchrome 1 ("SIL1"). As an example, the Inconel® Alloy may be such as Inconel751. Alternatively, the head 155 may be formed of a different material from the body 160, with the head 155 being formed of one of the above-noted materials, i.e., 23-8N, an Inconel® alloy, such as Inconel751, and SIL1, and the body 160 being formed of another of the above-noted materials. The materials used to form the head 155 and the body 160 of the exhaust valve 100 are selected based on the high temperature strength and corrosion resistance. Specifically, the materials may be selected based on properties such as the coefficient of thermal expansion and the usage range of the material, in addition to a tensile strength in view of the tensile forces applied to an exhaust valve by a valve spring. FIG. 2 is a schematic side view of the exhaust valve 100 shown in FIG. 1, in accordance with the present disclosure. With reference to FIG. 2, the exhaust valve 100 may have an overall length $L_{VALVE}$ of about 219 mm, the body 160 may have an overall length $L_{BODY}$ of about 192.5 mm, and a guided length $L_{GUIDED}$, which is a portion of the body 160 that is configured to be moved within the valve guide 135, in of about 90 mm. The guided length $L_{GUIDED}$ includes an upper end 210 and a lower end 215, as shown in FIGS. 1 and 2. A length $L_{TOP}$ between the upper end 170 of the body 160 to the upper end 190 of the tapered portion 185 may be about 116 mm, and a length $L_{BOTTOM}$ between the upper end 170 of the body 160 to the lower end 195 of the tapered portion 185 may be about 154 mm. A ratio between these lengths $L_{TOP}$ to $L_{BOTTOM}$ may be in a range of about 0.73 to about 0.76, or, more specifically, may be about 0.75. The location of the tapered portion 185 may also be defined relative to the guided length $L_{GUIDED}$, with the upper end 190 of the tapered portion 185 being located within the guided length $L_{GUIDED}$, and a lower end 195 of the tapered portion 185 coinciding with the lower end 215 of the guided length $L_{GUIDED}$. In addition, a ratio of the guided length $L_{GUIDED}$ to the overall length $L_{VALVE}$ of the exhaust valve 100 may be in a range of about 0.2 to about 0.5, and, as a more specific example, this ratio may be approximately 0.26 or 0.46.

The body 160 is generally cylindrical in shape, with a maximum diameter $D_{MAX}$ at the upper end 170 and a minimum diameter $D_{MIN}$ at the lower end 180. A diameter of the tapered portion 185 decreases from an upper end 190 of the tapered portion 185, adjacent to the upper portion 165 of the body 160, to a lower end 195 of the tapered portion 185, adjacent to the lower portion 175 of the body 160. In other words, the tapered portion 185 may have a maximum diameter $D_{MAX_TAPER}$ at the upper end 190 thereof, and a minimum diameter $D_{MIN_TAPER}$ at the lower end 195 thereof. The diameters of the tapered portion 185 may be in a range of about 9.441 mm to about 9.373 mm. Further, a taper magnitude, defined as a difference between the maximum diameter $D_{MAX_TAPER}$ and the minimum diameter $D_{MIN_TAPER}$ of the tapered portion 185, may be in a range of about 0.047 mm to about 0.117 mm, or, more specifically, about 0.088 mm. A length $L_{TAPER}$ of the tapered portion 185 may be about 38 mm. A taper T of the tapered portion 185, defined as the difference between the maximum diameter $D_{MAX_TAPER}$ and the minimum diameter $D_{MIN_TAPER}$ of the tapered portion 185, divided by the length $L_{TAPER}$ of the tapered portion 185, may be in a range of about 0.0012/mm to about 0.0030/mm, or, more specifically, 0.00232/mm. An angle $\theta_{TAPER}$ of the tapered portion 185 may be defined as a function of the taper T:

$$\theta_{TAPER} = \frac{\tan^{-1} T}{2},$$

and in the embodiment shown in FIGS. 1 and 2, the angle $\theta_{TAPER}$ may be in a range of about 0.03° to about 0.09°.

Figure 3:
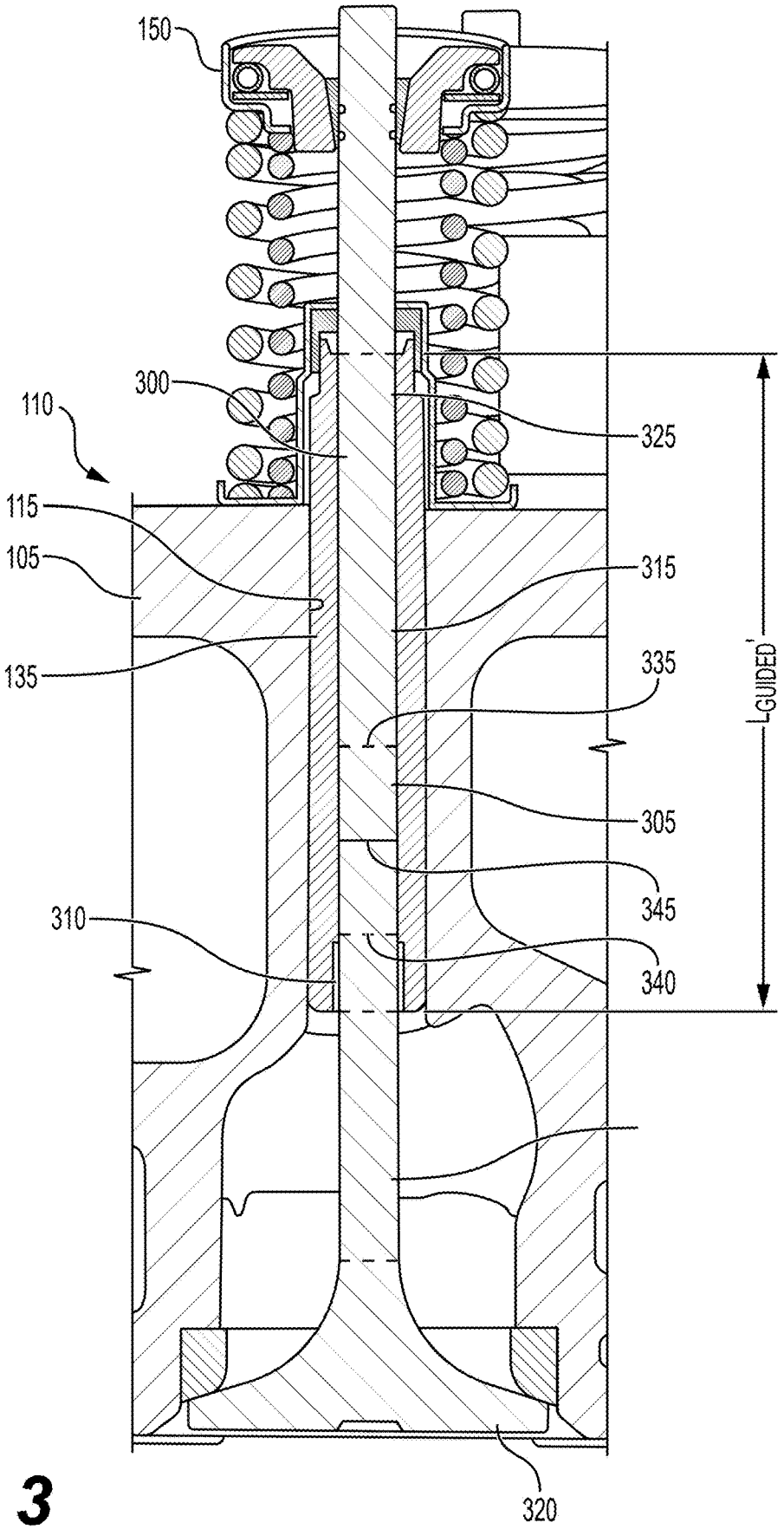
FIG. 3 shows a schematic cutaway cross-sectional view of an exhaust valve, according to another embodiment, within an engine head of an internal combustion engine, in accordance with the present disclosure.
Figure 4:
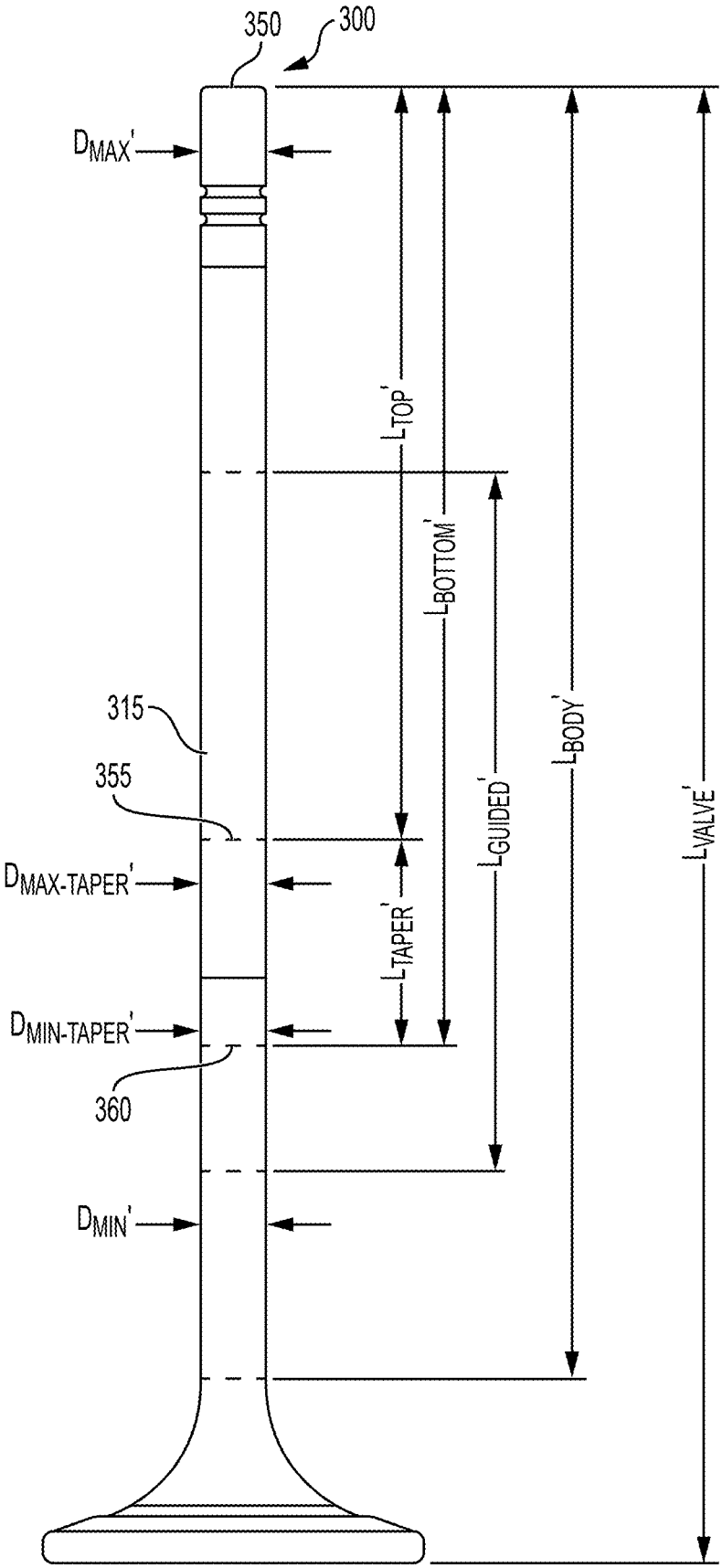
FIG. 4 is a schematic side view of the exhaust valve shown in FIG. 3, in accordance with the present disclosure.

FIG. 3 shows a schematic cutaway cross-sectional view of an exhaust valve 300, according to another embodiment, within an engine head 105 of an internal combustion engine 110, and FIG. 4 is a schematic side view of the exhaust valve 300 shown in FIG. 3, in accordance with the present disclosure. For conciseness, a detailed description of features of the engine head 105 and valve guide 135 that are the same as those shown in FIGS. 1 and 2 will not be repeated, except to describe differences of the embodiment of the exhaust valve 300 shown in FIGS. 3 and 4 from the embodiment of the exhaust valve 100 shown in FIGS. 1 and 2. The same reference numerals may be used for features of the engine head 105 and the valve guide 135 that are the same as those shown in FIGS. 1 and 2.

The features of the exhaust valve 300 shown in FIGS. 3 and 4 are generally the same as those of the exhaust valve 100 shown in FIGS. 1 and 2. However, the exhaust valve 300 shown in FIGS. 3 and 4 differs at least with respect to the following dimensions and ratios of same, with respect to the location of a tapered portion 305 relative to the guided length $L_{GUIDED}'$, and with respect to the location of the counter bore 310 relative to the tapered portion 305. With reference to FIG. 3, the exhaust valve 300 is positioned at least partially within the valve guide 135, and within the cylindrical bore 115 of the engine head 105. The exhaust valve 300 includes a body 315 and a head 320. The body 315 includes an upper portion 325, a lower portion 330, and a tapered portion 305, between the upper portion 325 and the lower portion 330, with both an upper end 335 and a lower end 340 of the tapered portion 305 being located within a guided length $L_{GUIDED'}$ of the body 315. The body 315 also includes an attachment point 345 at which two parts of the exhaust valve 300 may be attached using, for example, welding. In addition, the lower end 340 of the tapered portion 305 may be above a counter bore 310 of the exhaust valve 135, which may be about 11 mm in length from a lower end of the valve guide 135. Similar to the embodiment shown in FIG. 1, the counter bore 310 in this embodiment provides diametrical clearance between the valve guide 135 and the exhaust valve 100.

With reference to FIG. 4, the exhaust valve 300 may have an overall length $L_{VALVE'}$ in a range of about 219 mm, the body 315 may have an overall length $L_{BODY'}$ in a range of about 192.5 mm, and a guided length $L_{GUIDED'}$, which is a portion of the body 315 that is configured to be moved within the valve guide 135, of about 90 mm. A length $L_{TOP'}$ between the upper end 350 of the body 315 to the upper end 355 of the tapered portion 305 may be about 112 mm, and a length $L_{BOTTOM'}$ between the upper end 350 of the body 315 to a lower end 360 of the tapered portion 305 may be about 143 mm. A ratio between these lengths $L_{TOP'}$ to $L_{BOTTOM'}$ may be in a range of about 0.77 mm to about 0.79 mm, or, more specifically, may be 0.7832. The location of the tapered portion 305 may also be defined relative to the guided length $L_{GUIDED'}$, and, in this embodiment, both the upper end 355 and the lower end 360 of the tapered portion 305 may be located within the guided length $L_{GUIDED'}$. In addition, a ratio of the guided length $L_{GUIDED'}$ to the overall length $L_{VALVE'}$ of the exhaust valve 300 may be in a range of about 0.25 to about 0.50, and, as a more specific example, this ratio may be 0.26 or 0.46.

The diameters $D_{MAX_TAPER'}$, at the upper end 355 of the tapered portion 305 and a minimum diameter $D_{MIN_TAPER'}$, at the lower end 360 of the tapered portion 305 may be in a range of about 9.441 mm to about 9.346 mm. Further, a taper magnitude, defined as a difference between the maximum diameter $D_{MAX_TAPER'}$ and the minimum diameter $D_{MIN_TAPER'}$ of the tapered portion 305, may be in a range of about 0.057 mm to about 0.127 mm, or, more specifically, about 0.095 mm. A length $L_{TAPER'}$ of the tapered portion 305 may be about 31 mm. A taper T' of the tapered portion 305, defined as the difference between the maximum diameter $D_{MAX_TAPER'}$ and the minimum diameter $D_{MIN_TAPER'}$ of the tapered portion 305, divided by the length $L_{TAPER'}$ of the tapered portion 305, may be in a range of about 0.0012/mm to about 0.0031/mm, or, more specifically, 0.00306/mm. An angle $\theta_{TAPER}$ of the tapered portion 305 may be defined as a function of the taper T':

$$\theta_{TAPER'} = \frac{\tan^{-1} T'}{2},$$

and, in the embodiment shown in FIGS. 3 and 4, the angle $\theta_{TAPER'}$ may be in a range of about 0.05° to about 0.12°.

Figure 5:
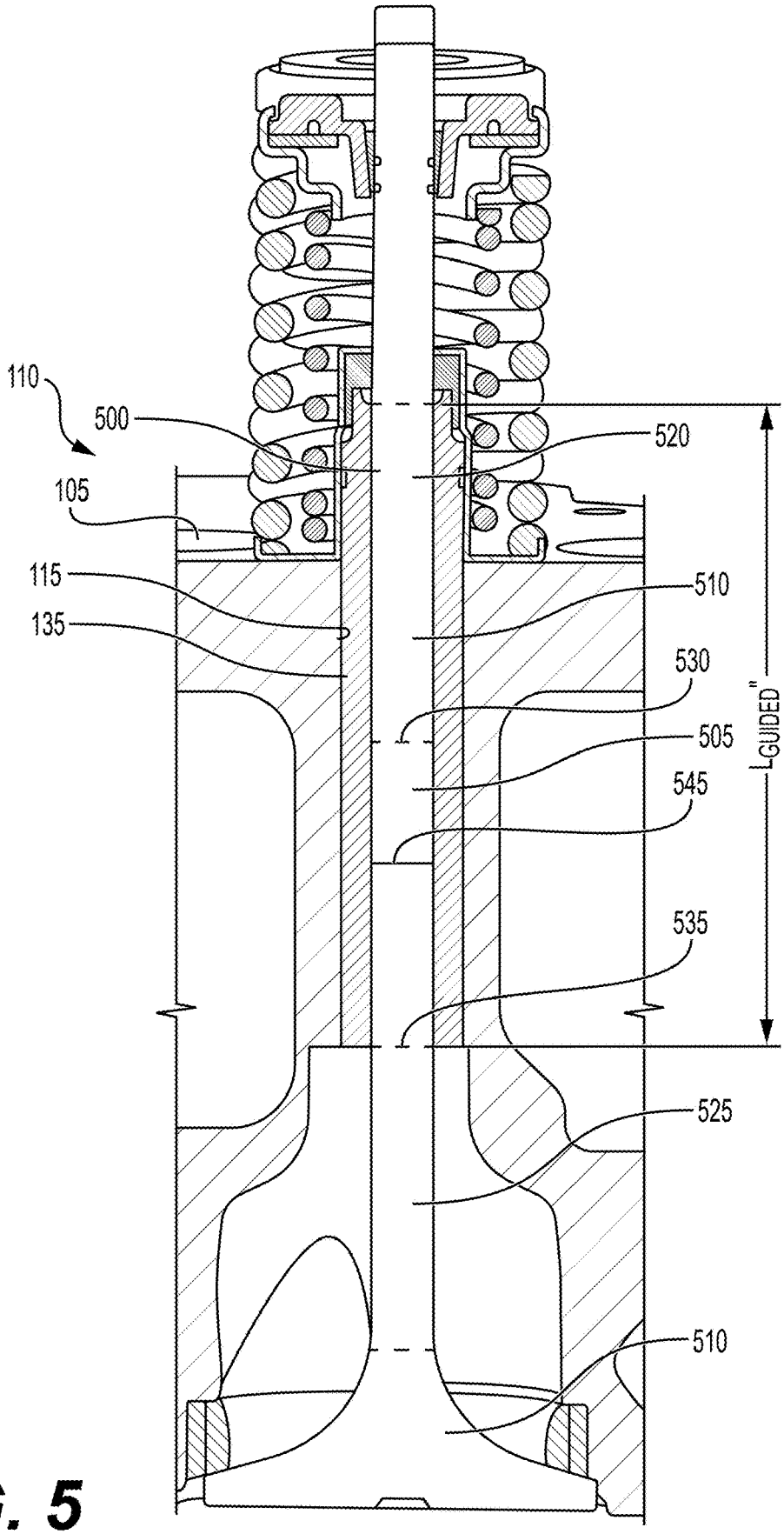
FIG. 5 shows a schematic cutaway cross-sectional view of an exhaust valve, according to still another embodiment, within an engine head of an internal combustion engine, in accordance with the present disclosure.
Figure 6:
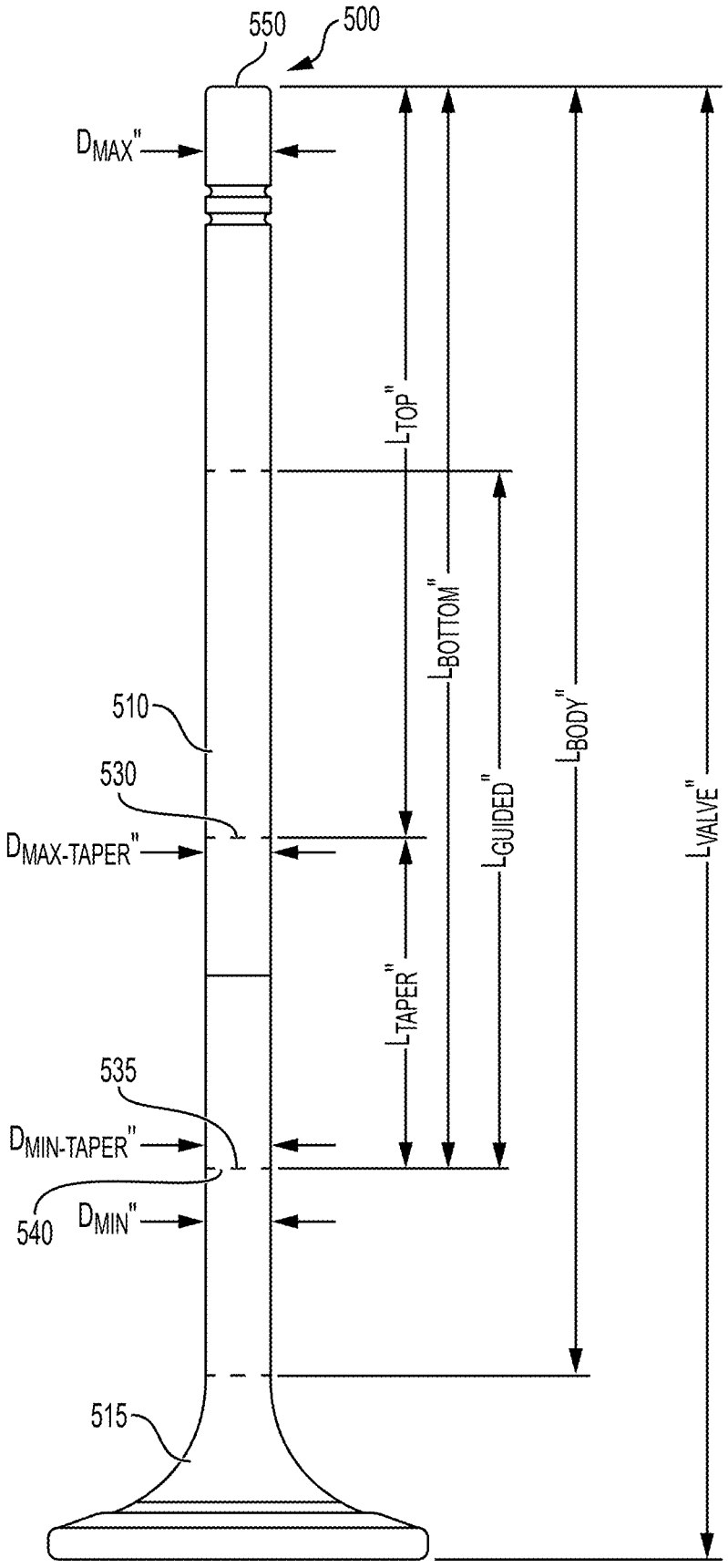
FIG. 6 is a schematic side view of the exhaust valve shown in FIG. 5, in accordance with the present disclosure.

FIG. 5 shows a schematic cutaway cross-sectional view of an exhaust valve 500, according to still another embodiment, within an engine head 105 of an internal combustion engine 110, and FIG. 6 is a schematic side view of the exhaust valve 500 shown in FIG. 5, in accordance with the present disclosure. For conciseness, a detailed description of features of the engine head 105 and valve guide 135 that are the same as those shown in FIGS. 1 and 2 will not be repeated, except to describe differences of the embodiment of the exhaust valve 500 shown in FIGS. 5 and 6 from the embodiment of the exhaust valve 100 shown in FIGS. 1 and 2. The same reference numerals may be used for features of the engine head 105 and the valve guide 135 that are the same as those shown in FIGS. 1 and 2.

The features of the exhaust valve 500 shown in FIGS. 5 and 6 are generally the same as those of the exhaust valve 100 shown in FIGS. 1 and 2. However, the exhaust valve 500 shown in FIGS. 5 and 6 differs at least with respect to the following dimensions and ratios of same and with respect to the valve guide 135 having no counter bore. With reference to FIG. 5, the exhaust valve 500 is positioned at least partially within the valve guide 135, and within the cylindrical bore 115 of the engine head 105. The exhaust valve 500 includes a body 510 and a head 515. The body 510 includes an upper portion 520, a lower portion 525, and a tapered portion 505, between the upper portion 520 and the lower portion 525, with an upper end 530 of the tapered portion 505 being located within a guided length $L_{GUIDED''}$ of the body 510, and a lower end 535 of the tapered portion 505 coinciding with a lower end 540 of the guided length $L_{GUIDED''}$ of the body 510. The body 510 also includes an attachment point 545 at which two parts of the exhaust valve 500 may be attached using, for example, welding.

With reference to FIG. 6, the exhaust valve 500 may have an overall length $L_{VALVE''}$ of about 219 mm, the body 510 may have an overall length $L_{BODY''}$ of about 192.5 mm, and a guided length $L_{GUIDED''}$, which is a portion of the body 510 that is configured to be moved within the valve guide 135, of about 90 mm. A length $L_{TOP''}$ between an upper end 550 of the body 510 to the upper end 530 of the tapered portion 505 may be about 110.5 mm, and a length $L_{BOTTOM''}$ between the upper end 550 of the body 510 to the lower end 535 of the tapered portion 505 may be about 150.5 mm. A ratio between these lengths $L_{TOP''}$ to $L_{BOTTOM''}$ may be in a range of about 0.7300 mm to about 0.7400 mm, or, more specifically, may be 0.7342. The location of the tapered portion 505 may also be defined relative to the guided length $L_{GUIDED''}$, and, in this embodiment, the upper end 530 of the tapered portion 505 may be located within the guided length $L_{GUIDED''}$ and the lower end 535 of the tapered portion 505 may coincide with a lower end 540 of the guided length $L_{GUIDED''}$. In addition, a ratio of the guided length $L_{GUIDED''}$ to the overall length of the exhaust valve $L_{VALVE''}$ may be in a range of about 0.25 to about 0.50, and, as a more specific example, this ratio may be 0.26 or 0.46.

The diameters $D_{MAX_TAPER''}$, at the upper end 530 of the tapered portion 505, and a minimum diameter $D_{MIN_TAPER''}$, at the lower end 535 of the tapered portion 505 may be in a range of about 9.441 mm to about 9.349 mm. Further, a taper magnitude, defined as a difference between the maximum diameter $D_{MAX_TAPER''}$ and the minimum diameter $D_{MIN_TAPER''}$ of the tapered portion 505, may be in a range of about 0.074 mm to about 0.144 mm, or, more specifically, about 0.109 mm. A length $L_{TAPER'}$ of the tapered portion 505 may be about 40 mm. A taper T" of the tapered portion 505, defined as the difference between the maximum diameter $D_{MAX_TAPER''}$ and the minimum diameter $D_{MIN_TAPER''}$ of the tapered portion 505 divided by the length $L_{TAPER''}$ of the tapered portion 505, may be in a range of about 0.00180/mm to about 0.00370/mm, or, more specifically, about 0.00235/mm. An angle $\theta_{TAPER''}$ of the tapered portion 505 may be defined as a function of the taper T":

$$\theta_{TAPER''} = \frac{\tan^{-1} T''}{2},$$

and, in the embodiment shown in FIGS. 5 and 6, the angle $\theta_{TAPER''}$ may be in a range of about 0.05° to about 0.11°.

INDUSTRIAL APPLICABILITY

The exhaust valves of the present disclosure, and the related method of manufacture described below, can be used in internal combustion engines. Specifically, exhaust valves of the present disclosure can be used in engine heads and be subjected to temperatures of up to about 650° C. with reduced likelihood of sticking and/or failing during operation.

Figure 7:
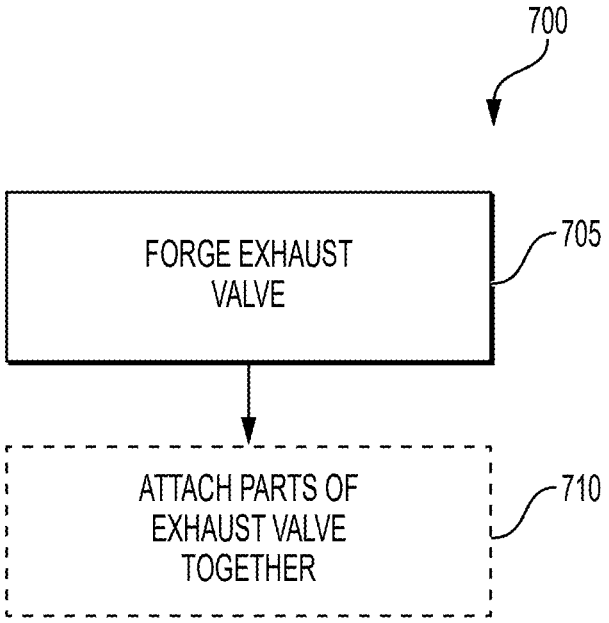
FIG. 7 shows a flow chart of a method of manufacturing an exhaust valve, in accordance with the present disclosure.

FIG. 7 shows a flow chart of a method 700 of manufacturing an exhaust valve, in accordance with the present disclosure. The method 700 may include a step 705 of forging an exhaust valve according to any one of the embodiments shown in FIGS. 1 to 6, and described above. That is, in one embodiment, the step 705 of forging an exhaust valve produces the exhaust valve having a body, including an upper portion, a lower portion, and a tapered portion between an upper end and a lower end, and a head portion extending from bottom of the lower portion of the body. The exhaust valve may be formed of a material as described herein.

Although the method 700 is described as including the step 705 described above, and shown in FIG. 7, the method 700 may include additional steps and/or substeps. For example, the step 705 of forging the exhaust valve may include forging the exhaust valve in two parts, and the method may further include a step 710 of attaching the two parts of the exhaust valve together at an attachment point. The two parts may be attached using welding. The attachment point may be located within the tapered portion.

By virtue of the exhaust valves of the present disclosure, and the related method of manufacture, it is possible to form an exhaust valve that will function smoothly, without sticking to a valve guide, and without failing, during operation of an internal combustion engine. In particular, the exhaust valves having bodies with tapered portions, as described herein, and formed of the particular materials described herein, may function to be "straight when hot," that is, the tapered portion of the exhaust valve may expand to be straight when a head of the exhaust valve is exposed to relatively high temperatures. Also, by virtue of the maximum and minimum diameters of the body of the exhaust valve of each embodiment described herein, and by virtue of the material used to form the exhaust valve, a diametric clearance greater than 0 μm (or a "positive clearance") between the exhaust valve and the valve guide may be ensured even in extreme conditions to prevent sticking of the exhaust valve and failure of the exhaust valve. Such extreme conditions may be considered "worst-case boundary conditions, with a valve guide being at a relatively low temperature, for example, 20° C., an exhaust valve being at a relatively high temperature, for example, 650° C., and a temperature difference between the valve guide and the exhaust valve being a maximum value, for example, 630° C.

It will be apparent to those skilled in the art that various modifications and variations can be made to the disclosed exhaust valve and related method of manufacture, without departing from the scope of the disclosure. Other embodiments of the exhaust valve and method of manufacture will be apparent to those skilled in the art from consideration of the specification and the accompanying figures. It is intended that the specification, and, in particular, the examples provided herein be considered as exemplary only, with a true scope of the disclosure being indicated by the following claims and their equivalents.

The invention claimed is:

1. An exhaust valve for an internal combustion engine, the exhaust valve comprising:

a body, including an upper portion, a lower portion, and a tapered portion between an upper end and a lower end of the body, wherein a ratio of (a) a length between an upper end of the upper portion and an upper end of the tapered portion to (b) a length between the upper end of the upper portion and a lower end of the tapered portion is in a range of 0.73 to 0.76, and a taper of the tapered portion, measured as a difference between a maximum diameter of the tapered portion and a minimum diameter of the tapered portion, divided by a length of the tapered portion, is in a range of 0.0012/mm to 0.0030/mm; and a head portion extending from a bottom of the lower portion of the body.

2. The exhaust valve according to claim 1, wherein an angle of the tapered portion is in a range of 0.03° to 0.09°.

3. The exhaust valve according to claim 1, wherein the body further includes a weld located within the tapered portion.

4. The exhaust valve according to claim 1, wherein the body has a guided length along which the exhaust valve is configured to move within a valve guide, and an upper end of the tapered portion is within the guided length and a lower end of the tapered portion coincides with a lower end of the guided length.

5. The exhaust valve according to claim 4, wherein a ratio of the guided length to a valve length is in a range of 0.2 to 0.5.

6. The exhaust valve according to claim 1, wherein the body is formed of one or more alloys.

7. The exhaust valve according to claim 6, wherein each alloy, of the one or more alloys, is selected from the group consisting of: 23-8N, an Inconel® alloy, and SIL1.

8. An exhaust valve for an internal combustion engine, the exhaust valve comprising:

a body including an upper portion, a lower portion, and a tapered portion between an upper end and a lower end, wherein a ratio of (a) a length between an upper end of the upper portion and an upper end of the tapered portion to (b) a length between the upper end of the upper portion and a lower end of the tapered portion is in a range of 0.77 to 0.79, and a taper of the tapered portion, measured as a difference between a maximum diameter of the tapered portion and a minimum diameter of the tapered portion, divided by a length of the tapered portion, is in a range of 0.0012/mm to 0.0031/mm; and a head portion extending from bottom of the lower portion of the body, wherein the exhaust valve is formed of one or more alloys, each alloy being selected from the group consisting of: 23-8N, an Inconel® alloy, and SIL1.

9. The exhaust valve according to claim 8, wherein an angle of the tapered portion is in a range of 0.05° to 0.12°.

10. The exhaust valve according to claim 8, wherein the body further includes a weld located within the tapered portion.

11. The exhaust valve according to claim 8, wherein the body has a guided length along which the body is configured to move within a valve guide, and both an upper end and a lower end of the tapered portion are within the guided length.

12. The exhaust valve according to claim 11, wherein a ratio of the guided length to a valve length is in a range of 0.25 to 0.50.

13. The exhaust valve according to claim 8, wherein the body and the head portion are formed of different alloys.

14. A method of manufacturing an exhaust valve for an internal combustion engine, the method comprising:

forging an exhaust valve to have:

a body, including an upper portion, a lower portion, and a tapered portion between an upper end and a lower end, wherein a ratio of (a) a length between an upper end of the upper portion and an upper end of the tapered portion to (b) a length between the upper end of the upper portion and a lower end of the tapered portion is in a range of 0.73 to 0.76, and a taper of the tapered portion, measured as a difference between a maximum diameter of the tapered portion and a minimum diameter of the tapered portion, divided by a length of the tapered portion, is in a range of 0.0012/mm to 0.0031/mm; and a head portion extending from bottom of the lower portion of the body, wherein the exhaust valve is formed of one or more alloys.

15. The method according to claim 14, wherein an angle of the tapered portion is in a range of 0.03° to 0.09°.

16. The method according to claim 14, further comprising attaching at least two parts of the exhaust valve together, at an attachment point located within the tapered portion of the body of the exhaust valve.

17. The method according to claim 16, wherein the at least two parts are attached using welding, and the attachment point located within the tapered portion is a weld.

18. The method according to claim 14, wherein the body has a guided length along which the body is configured to move within a valve guide, and an upper end of the tapered portion is formed to be within the guided length and a lower end of the tapered portion is formed to coincide with a lower end of the guided length.

19. The method according to claim 18, wherein a ratio of the guided length to a valve length is in a range of 0.2 to 0.5.

20. The method according to claim 14, wherein each alloy, of the one or more alloys, is selected from the group consisting of: 23-8N, an Inconel® alloy, and SIL1.

* * * * *